United States Patent [19]

Arey, Jr. et al.

[11] 3,959,116

[45] *May 25, 1976

[54] REFORMING PROCESS UTILIZING A DUAL CATALYST SYSTEM

[75] Inventors: William Floyd Arey, Jr.; Glen Porter Hamner, both of Baton Rouge, La.

[73] Assignee: Exxon Research and Engineering Company, Linden, N.J.

[ * ] Notice: The portion of the term of this patent subsequent to July 18, 1984, has been disclaimed.

[22] Filed: Oct. 15, 1965

[21] Appl. No.: 496,659

[52] U.S. Cl. ..... 208/66; 208/62

[51] Int. Cl.[2] ..... C10G 39/00

[58] Field of Search ..... 208/63–66, 208/138, 139

[56] References Cited

UNITED STATES PATENTS 3,331,767 7/1967 Arey et al. ..... 208/111

*Primary Examiner*—Delbert E. Gantz
*Assistant Examiner*—James W. Hellwege
*Attorney, Agent, or Firm*—John J. Schlager; Roy J. Ott

[57] ABSTRACT

Previously hydroformed feedstocks are upgraded to improve their octane rating by contacting said feedstocks in the presence of hydrogen with a sulfactivated catalyst comprising a metallic hydrogenation component, such as a platinum group metal, in combination with a crystalline aluminosilicate zeolite having uniform pore openings of about 5 Angstrom units. In its more specific aspects, the catalyst further contains a Group II-B metal such as zinc.

13 Claims, No Drawings

REFORMING PROCESS UTILIZING A DUAL CATALYST SYSTEM

This invention relates to the catalytic upgrading of petroleum naphthas, particularly after the latter have been subjected to a hydroforming treatment. More particularly, the invention relates to a multiple stage hydroforming process utilizing a conventional large pore reforming catalyst in the first stage or stages and a small pore crystalline aluminosilicate zeolite catalyst in the last stage.

Reforming operations are well known in the petroleum industry. Catalytic hydroforming is a widely used process for treating hydrocarbons in the naphtha boiling range to convert or transform them into more useful products. For example, hydroforming is used to convert broad range naphtha cuts into motor fuels of greatly improved anti-knock and volatility characteristics. By "hydroforming" is usually meant a process wherein hydrocarbon fractions boiling in the motor fuel or naphtha range are treated at elevated temperatures and pressures in the presence of certain solid catalysts and hydrogen. The hydrocarbon is usually increased in aromaticity, with no net consumption of hydrogen. The hydroforming process usually consists of treating hydrocarbon vapors in the presence of hydrogen or a hydrogen-rich recycle gas at temperatures of 750° to 1150°F. and pressures of 50 to 1000 psig with such catalysts as the oxides or sulfides of metals of Groups IV, V, VI, VII, and VIII of the Periodic System of Elements, either alone or preferably supported on a suitable, relatively large pore size base, such as alumina gel, precipitated alumina, zinc-alumina spinel, chromia-alumina, silica-alumina, etc. By "relatively large pore size" is meant a pore size greater than about 6A. More particularly, typical hydroforming catalysts will include the oxides of Group VI metals such as molybdenum or chromium, a metal of the palladium series, such as platinum, palladium, osmium, iridium, ruthenium, or rhodium deposited on a suitable support, such as silica alumina, or components thereof. These catalysts may contain varying amounts of halogens, boria, or other components designed to enhance their activity or selectivity. A preferred catalyst will be platinum (e.g. 0.02 to 2.0 wt. %) on alumina containing a minor amount (e.g. 0.1 to 0.5 wt. %) of a chloride of fluoride.

The hydroformed product stream (hydroformate) will usually contain a substantial portion (e.g. 1 to 15 wt. %) of normal paraffinic hydrocarbons which have an undesirably low octane rating. Accordingly, it has been proposed to separate these low octane materials or selectively convert them to lower boiling, easily removable products. It is the major object of the present invention to provide an improved method for upgrading the product obtained from hydroforming petroleum naphtha fractions to thereby increase its octane rating. It is therefore the general purpose of the invention to upgrade a previously hydroformed naphtha feed and to recover an enhanced quality product. The initial hydroforming operation can be accomplished with any of the conventional catalysts hereinbefore described and preferably the platinum-on-alumina catalyst. This initial hydroforming can be accomplished in one or more stages by conventional means.

The upgrading of hydroformate in accordance with the present invention is accomplished by contacting the reformed naphtha stream in the presence of gaseous hydrogen which may be the reformer effluent gas and/or added hydrogen with a relatively small pore catalyst which can be characterized as a crystalline aluminosilicate zeolite. By "relatively small pore size" is meant a pore size of below about 6A units, particularly 4 to less than 6A, e.g. about 5A. More particularly, the catalyst employed will have pores capable of affording entry to the objectionable normal paraffinic hydrocarbons but incapable of admitting the more valuable branched and cyclic hydrocarbons. The result of such treatment is to selectively convert the normal paraffinic components to lower boiling saturated products which can then be readily recovered, thereby leaving a naphtha product of highly improved quality. By means of the present process, a substantial improvement in octane rating is realized. For example, typical hydroformates having research octane ratings in the neighborhood of about 90 can be upgraded to ratings of about 100 or higher.

Crystalline metallo alumino-silicate zeolites having uniform pore openings of less than about 6A contemplated for use in this invention are well known and available in synthetic or natural form. For example, a suitable starting material, referred to as "Zeolite A" in U.S. Pat. No. 2,882,243, has a molar formula (dehydrated form) of $$1.0 \pm 0.2\ M_{(2/n)}O{:}Al_2O_3{:}1.85 \pm 0.5\ SiO_2$$

where M is a metal usually sodium and $n$ is its valence. It may be prepared by heating a mixture containing $Na_2O$, $Al_2O_3$, $SiO_2$, and $H_2O$ (supplied by suitable source materials) at a temperature of about 100°C. for 15 minutes to 90 hours or longer. Suitable ratios of these reactants are fully described in the aforementioned patent.

One suitable process for preparing such materials synthetically involves, for example, the mixing of sodium silicate, preferably sodium metasilicate, with sodium aluminate under carefully controlled conditions. The sodium silicate employed should have a ratio of soda to silica between about 0.8 to 1 and about 2 to 1; and the sodium aluminate may have a ratio of soda to alumina in the range of from about 1 to 1 to about 3 to 1. The amounts of the sodium silicate and sodium aluminate solutions employed should be such that the ratio of silica to alumina in the final mixture ranges from about 0.8 to 1 to about 3 to 1 and preferably from about 1 to 1 to about 2 to 1. Preferably, the aluminate is added to the silicate at ambient temperature with sufficient agitation to produce a homogeneous mixture. The mixture is then heated to a temperature of from about 180° to about 215°F. and held at that temperature for a period of from about 0.5 to about 3 hours or longer. The crystals may be formed at lower temperatures but longer reaction periods will be required. At temperatures above about 250°F. a crystalline composition having the requisite uniform size pore openings is not obtained. During the crystallization step the pH of the solution should be maintained on the alkaline side at about 12 or higher. At lower pH levels crystals having the desired properties are not as readily formed.

The products produced by the above procedure will have uniform pore openings of about 4A as produced in the sodium form. They may then be converted to products having uniform pore openings of about 5A by replacement of the sodium via conventional ion exchange techniques with cations of magnesium, cobalt, nickel, iron, manganese, zinc, etc., all of which, however, are not suitable for purposes of this invention.

Natural zeolites having efective pore diameters of about 5A are also herein contemplated and will include such materials as erionite, chabazite, analcite, mordenite and the like. Thus, both the natural and synthetic varieties of 5A zeolites are contemplated with the only limitation being one of pore size. As indicated, the pore size must be sufficient to substantially admit the straight-chain hydrocarbons but insufficient to admit the valuable high octane producing components, such as the aromatics, so as to avoid their conversion. This capacity should, therefore, be demonstrated at the particular conditions contemplated, since the effective pore diameter of these zeolite materials often varies with temperature and pressure.

In accordance with the invention, it has been found that indiscriminate use of the above-mentioned cations is not suitable for the purposes of the invention. More particularly, it has been found that cations of metals in Group II-B of the Periodic Table (*Handbook of Chemistry and Physics*, 38th Edition, Chemical Rubber Publishing Co.) are peculiarly suited to the purposes of the present invention. These will include cadmium and zinc cations, with zinc cation being particularly preferred. Thus, the catalyst used in the present invention is prepared from a crystalline alumino-silicate zeolite which, preferably after zinc cation exchange, has uniform effective pore openings of about 5A in diameter. The most preferred cation solution will be an aqueous solution of a zinc salt, such as zinc chloride, zinc acetate, etc. The extent of the ion exchange should be sufficient to reduce the alkali metal, e.g. sodium content of the zeolite to less than 10 wt. %, and preferably less than 5 wt. %. The ion exchange is preferably conducted to cause at least 25%, and more preferably greater than 50%, of the exchangeable cation content to be divalent by replacement with the preferred zinc cation. It will be understood that although the most preferred catalysts will be prepared by using zinc cation as the sole exchanging cation, the presence of zinc together with other exchanging cations, such as hydrogen cation, will also be highly useful. Thus, the present invention contemplates the use of a 5A zeolite containing zinc or cadmium cation. Preferably the zeolite will have a major portion of its cation content supplied by zinc (or cadmium) with perhaps minor portions of residual sodium as well as minor portions of other ions which may also have been introduced via ion exchange for various purposes. With some 5A zeolites, especially those of high silica content, the hydrogen form will also be a useful catalyst support.

As a further step in the preparation of the catalysts of the invention, the catalyst is combined with an active metallic hydrogenation component which may be chosen from Groups V-B, VI-B, VII-B, or VIII of the Periodic Table and which is suitably exemplified by the metals cobalt, nickel, platinum, palladium, etc. The hydrogenation component may be in the form of the free metal as in the case of platinum group metals, or as the oxide or sulfide as in the case of cobalt, etc., or mixtures of such metals, oxides, or sulfides. Platinum group metals (i.e. metals of the platinum and palladium series) will be preferred for purposes of the present invention, with palladium being particularly preferred. Incorporation of the hydrogenation component may be accomplished by any conventional technique, such as ion exchange followed by reduction, impregnation, etc.

When palladium is employed, the zinc-exchanged alumino-silicate is preferably impregnated with an ammoniacal solution of palladium chloride sufficient to produce the desired amount of hydrogenation metal in the final product, and then dried and calcined at a temperature of 800° to 1000°F. Reduction of the metal is then accomplished either separately or in the hydrocracking reaction per se. The amount of hydrogenation component may range from about 0.1 to about 25 wt. % based on the weight of final product. In the case of platinum group metals, e.g. palladium, the preferred amount will be in the range of about 0.1 to 6, e.g. 0.5 to 3 wt. %, based on dry catalyst.

As an additional preferred embodiment of the present invention, it has been found that the activity and effectiveness of the catalysts used herein is substantially improved by contact with sulfur prior to their use in the selective hydrocracking process. The catalyst is preferably sulfactivated to enhance its activity by contact either with a sulfur-containing feed or, if the feed has a low sulfur content, with hydrogen sulfide or an added sulfur compound which is readily convertible to hydrogen sulfide at the conditions employed, e.g. carbon disulfide and the like. The extent of this sulfactivation treatment should be sufficient to incorporate about 0.5 to 15 wt. % sulfur into the catalyst.

It is fully recognized that the prior art has taught the use of crystalline alumino-silicate zeolites for cracking of various petroleum and hydrocarbon materials. For example, U.S. Pat. Nos. 2,971,903 and 2,971,904 disclose various hydrocarbon conversion processes employing crystalline aluminosilicates having uniform pore openings between about 6 and 15A. As hereinbefore mentioned, the present invention employs crystalline alumino-silicates having uniform pore openings of about 5A, which pore size has been found to be necessary and critical to the successful selective conversion and naphtha upgrading herein contemplated. The prior art has also recognized the possibility of selectively cracking normal paraffins by means of 5A molecular sieves for such purposes as dewaxing, etc. These uses derive from the ability of these crystalline zeolite materials to selectively admit certain sized molecules into their pores while rejecting others. Since these materials are now well-known adsorbents and catalysts, they provide highly efficient and valuable tools for selectively converting specified constituents of a hydrocarbon feed. For example, U.S. Pat. No. 3,039,953 discloses the selective conversion of normal paraffins with a 5A zeolite. Also, U.S. Pat. No. 3,140,322 relates generally to selective catalytic conversion utilizing crystalline zeolites and mentions dehydration, catalytic cracking, hydrogenation, etc.

The essence of the present invention, which distinguishes it from the above prior art teachings, lies in the surprising discovery that, in the presence of hydrogen, certain unique 5A crystalline alumino-silicates are superior catalyst components for octane number improvement of hydroformed naphtha feeds in particular. For example, the palladium-zinc cation-containing 5A zeolite combined with a metallic hydrogenation component has a strikingly greater activity in the presence of hydrogen than similar catalysts based on other cationic forms of the zeolite. Furthermore, the present invention contemplates a unique combination of conventional hydroforming operation and selective hydroconversion, the net result of which is the production of an extremely high quality gasoline product.

The process of the invention should also be distinguished from the conventional adsorption-desorption processes which are well known in the art. The present process involves a selective conversion of certain low octane-producing molecules, such as straight-chain hydrocarbons, to gaseous materials, such as butane and lighter fractions which are easily removed. The invention does not contemplate, therefore, a mechanical separation of diverse molecules, as accomplished by the conventional adsorption-desorption phenomenon. In the case of selective conversion, converted products are not retained within the pores of the zeolite and a desorption step is unnecessary thereby making the process economically attractive.

The operating conditions utilized in the initial hydroforming stage or stages using the relatively large pore size catalyst will include a temperature above about 700°F., preferably between about 800° and 1000°F., more preferably between about 880° and 950°F. The pressure will generally fall within the range of about 50 to 1000 psig, preferably about 200 to about 700 psig, more preferably between 275 to 400 psig. The liquid hourly space velocity will usually range between about 0.5 to about 10 V/V/Hr., preferably between about 1 to 5, more preferably about 1 to 2 V/V/Hr. The hydrogen rate employed will usually fall within about 1000 to 8000 standard cubic feet per barrel, preferably 2000 to 6000, more preferably 2500 to 5000 scf/barrel of hydrogen. As hereinbefore mentioned, the preferred hydroforming catalyst for use in the initial stages of the present process will be a platinum-on-alumina base catalyst containing about 0.3 to 0.6 wt. % platinum, the alumina having been treated to incorporate about 0.1 to 0.5 wt. % of a chloride or fluoride.

The conditions utilized in the last stage of the present process, i.e. that stage employing the relatively small pore crystalline alumino-silicate zeolite, will be generally similar to those used in the initial stages. This will be preferred so that the various stages can be operable in tandem at the same pressure and utilizing the same recycle gas circuit. Moreover, it is contemplated herein that the hydrogen produced in the initial conventional hydroforming stages be utilized as a hydrogen source for the final conversion stage which consumes a small quantity of hydrogen. The operating conditions utilized in the stage employing the crystalline alumino-silicate zeolite include a temperature of about 750° to 950°F. and a pressure of about 50 to 1000 psig at the hydrogen gas rates employed in the first hydroforming stage or stages. Preferred conditions will include a temperature of about 800° to 950°F., a pressure of about 275 to 500 psig, a space velocity of about 1 to 30, e.g. 1 to 10 V/V/Hr., at the hydrogen gas rates previously set forth.

The hydrocarbon feedstocks which are hydroformed in accordance with the present process will include mixtures of hydrocarbons and particularly petroleum distillates boiling within the approximate range of 60° to about 450°F., which range will include naphthas, gasolines, and kerosenes. Although the gasoline fraction may be a full boiling range gasoline, it will preferably be a naphtha having an initial boiling point between about 150° and about 250°F. and having an end boiling point of about 350° and about 425°F. It will be appreciated that the above charge stocks, catalysts, and conditions will, to the extent possible, be those conventionally employed in hydroforming operations.

It will be understood that the present process can be conducted in a multiple of stages or in a two-stage operation. In any event, however, the final stage will contain the crystalline zeolite catalyst which serves to convert the straight-chain hydrocarbons to lower boiling materials, thereby causing substantial upgrading in the octane rating of the previously hydroformed feed. Thus a number of conventional hydroforming stages can be employed prior to the final crystalline zeolite conversion treatment. The hydroformate produced as a result of the initial conventional hydroforming stage or stages will be composed of a mixture of hydrocarbons, which includes normal paraffins, branched paraffins, such as isoparaffins, and cyclic hydrocarbons. In accordance with the present invention, the entire hydroformate can be subjected to the crystalline zeolite conversion treatment; or a selected fraction of this hydroformate can be conducted into contact with the crystalline zeolite catalyst. Thus a selected fraction of the hydroformate can be separated by such means as fractionation, said fraction containing a high proportion of undesirable straight-chain hydrocarbon materials, and then separately contacted with the crystalline zeolite catalyst so as to upgrade it, and thereafter blended back with the remainder of the hydroformate so as to achieve an overall increase in octane rating without subjecting the entire hydroformate to the crystalline zeolite catalyst treatment. Such a selected fraction will preferbly boil within the range of about 100° to 250°F. Further, while fixed bed operation and downflow operation with concurrent hydrogen and feed will be preferred, other conventional techniques will be suitable.

The invention will be further understood by reference to the following examples which are given for illustrative purposes.

EXAMPLE 1

A hydroforming operation in accordance with the present invention was carried out with a feedstock which was a 50° to 380°F. boiling fraction of a 90 research octane number (clear) hydroformate obtained by subjecting a naphtha boiling in the range of 200° to 350°F. with a commercially available platinum-alumina reforming catalyst containing 0.5 wt. % platinum under reforming conditions which included a temperature of about 905°F., a pressure of about 400 psig, a liquid hourly space velocity of 4, and a recycle gas rate of about 4000 scf/barrel of feed, the hydrogen content of the recycle gas being 85–95%. The hydroformate was contacted in its entirety with a palladium-on-zinc form 5A crystalline alumino-silicate zeolite. This catalyst was prepared as follows:

A charge of 500 grams of commercial sodium "Zeolite A" (supplied by the Linde Division of Union Carbide Corporation) having pore openings of about 4A was suspended in 2000 cc. of water and a solution containing one pound of zinc chloride in 500 cc. of water was added slowly with good stirring at ambient temperature. Agitation was continued at ambient temperature for at least four hours. The suspension was allowed to settle, the mother liquor was removed by filtration. This procedure was performed on the wet solids two more times so that the total number of exchanges was three. After the third exchange the product was water-washed by reslurrying in about 2000 cc. of water for about one hour followed by removal of the wash liquid by filtration. The wash was repeated two times and the product dried. Analysis of the product showed 0.83 wt. % sodium, 20.8 wt. % zinc, 38.1 wt. % $SiO_2$, and 30.8 wt. % $Al_2O_3$. The product was then combined with palladium by adding 133 cc. of an ammoniacal palladium chloride solution having a palladium content of 37.5 milligrams per cc. to 500 grams of product suspended in water. The final catalyst, after drying, had a palladium content of 0.89% and was pelleted and charged to a small fixed bed pilot plant reactor where it was heated in a hydrogen stream at atmospheric pressure and 850°F. The above catalyst was finally sulfactivated by contact with a heavy naphtha feed until the catalyst contained an appreciable amount of sulfur, i.e. about 16 wt. %. The conditions utilized in the upgrading of the hydroformate feed with the crystalline zeolite catalyst included a temperature of 915°F., a pressure of 590 psig, a feed rate of 30 V/V/Hr., and a hydrogen gas rate of 2500 cubic feet of hydrogen per barrel. A liquid product yield of 98.5 volume % resulted. The distribution and inspections of the liquid product and the original hydroformate feed are given in the following table:

TABLE I

| Distribution | Liquid Product | Hydroformate Feed |
|---|---|---|
| $C_3$, wt. % | — | 1.3 |
| $C_4$, wt. % | 2.0 | 4.3 |
| $C_5$, wt. % | 98.0 | 94.4 |
| | 100.0 | 100.0 |
| Inspections | | |
| RON Clear | 91.6 | 90.2 |
| RON + 2 cc. TEL | 99.2 | 97.8 |
| MON Clear | 83.0 | 81.0 |
| MON + 2 cc. TEL | 93.8 | 91.3 |
| Gravity °API | 50.1 | 50.9 |

It will be observed that a substantial improvement in product quality was realized by contacting the hydroformate with the small pore crystalline zeolite catalyst in accordance with the present invention.

EXAMPLE 2

To demonstrate the effectiveness and utility of other crystalline zeolites having effective pore diameters of about 5A in the process of the invention, a catalyst prepared from the natural mineral erionite was used to upgrade the hydroformate feed of Example 1. Erionite is a naturally occurring zeolite having elliptical pore openings of 4.7 to 5.2A on the major axis. A sample of erionite was suspended in water and exchanged with zinc chloride solution in a manner similar to the procedure used in Example 1. The zinc-containing erionite product was then combined with palladium essentially following the procedure of Example 1, and the final catalyst analyzed 7.7 wt. % zinc, 0.67 wt. % sodium, 63 wt. % silica, 14.7 wt. % alumina, 0.61 wt. % palladium and 2.72 wt. % potassium. The product was pelletized for use in a fixed bed test unit and was sulfactivated by contact with $C_5$-$C_6$ naphtha stream containing 1% carbon disulfide over a 20 hour period at 700°F., 500 psig, 4 V/V/Hr. and 2000 $SCFH_2$/Bbl. gas rate.

The above sulfided palladium on zinc-containing erionite catalyst was utilized to selectively upgrade the hydroformate feed of Example 1 in the presence of added hydrogen and, for comparison purposes, in the absence of added hydrogen. It will be recognized that in the later case, the procedure will be similar to the selective cracking processes heretofore known to the art. The results obtained are summarized in the following table.

TABLE II

| | | Hydrogen Absent | Hydrogen Present |
|---|---|---|---|
| Process Conditions | | | |
| Temperature, °F. | 920 | 920 | |
| Pressure, psig | 10 | 500 | |
| Feed Rate, V/V/Hr. | 2 | 8.7 | |
| $H_2$Gas Rate,SCF/Bbl.Feed | | None | 2000 |
| $C_5$ + Yield, wt. % | | 98.7 | 94.3 |
| Liquid Product Inspections | Feed | | |
| Gravity, API | 47.0 | 46.3 | 44.6 |
| Octane Data | | | |
| RON Clear | 95.7 | 97.4 | 99.8 |
| RON +3 cc TEL | 101.1 | 101.6 | 103.6 |
| MON Clear | 84.8 | 84.0 | 88.2 |
| MON +3 cc TEL | 90.5 | 91.0 | 95.0 |
| Normal $C_5$+ Paraffins, wt. % | 7.5 | 7.2 | 1.9 |

As indicated, the erionite catalyst was highly effective in upgrading the hydroformate feed when hydrogen was present as shown by the substantial increase in octane number and the marked reduction in normal $C_5$+ paraffin content. Furthermore, when the results obtained in the presence of hydrogen are compared with those obtained in the absence of hydrogen, the unexpected superiority of the process of the present invention becomes readily apparent. Thus, the performance of selective cracking, as indicated by the data obtained in the absence of hydrogen, is observed to be decidedly inferior to that shown for the zinc erionite catalyst in the presence of hydrogen and with the added palladium hydrogenation component. The superior performance of the selective upgrading of hydroformate in accordance with the present invention is clearly illustrated.

EXAMPLE 3

The hydroforming operation of Example 1 was repeated essentially except that a 96.6 research octane number (clear) hydroformate was utilized, said hydroformate having been produced under essentially the same reforming conditions except that the temperature was raised to 920°F. and the feed rate lowered to 2 W/W/Hr. The same relatively small pore size sulfactivated palladium-zinc crystalline zeolite was utilized as in Example 1. The following table summarized the process conditions employed for the treating of the hydroformate feed and the results obtained:

TABLE III

| | | | | |
|---|---|---|---|---|
| Process Conditions | | | | |
| Temperature, °F. | | 800 | 850 | 880 |
| Pressure, psig | | ————460 | | |
| | | | | ———— |
| Feed Rate, V/V Hr. | | 0.5 | 1.0 | 1.0 |
| $H_2$ Rate, SCF/Bbl. | | ————5000 | | |
| | | | | ———— |
| | FEED | | | |
| Liquid Product Recovery, Vol.% | 100 | 96.4 | 95.7 | 95.7 |
| Liquid Product Inspections | | | | |
| Gravity, °API at 60°F. | 47.5 | 46.8 | 46.5 | 46.7 |
| Octane Data | | | | |
| RON Clear | 96.6 | — | 98.0 | 99.2 |
| RON + 3 cc TEL | 101.4 | 102 | | |
| MON Clear | 83.9 | — | 87.0 | 88.0 |
| MON + 3 cc TEL | 90.3 | 92 | | |

As indicated, increased octane number was again obtained even though the hydroformate feed was already of high quality. The octane gain at these high levels is significant.

EXAMPLE 4

To demonstrate the superiority of the relatively small pore size crystalline zeolite catalyst in upgrading hydroformed feeds over conventional hydroforming catalysts, two runs were performed. In the first, a 95.7 research octane number hydroformate feed was contacted with a commercially available hydroforming catalyst which contained 0.3 wt. % platinum, 0.4 wt. % chlorine and 99.3 wt. % alumina. In the second, the same hydroformate feed was contacted with the palladium-zinc-erionite catalyst of Example 2. The feedstock was obtained from a reforming operation essentially similar to that described in Example 1. The normal paraffin content of this hydroformate feed was as follows: 2.6 wt. % $C_5$, 1.6 wt. % $C_6$, 2.1 wt. % $C_7$, and 1.2 wt. % $C_8$; with a total normal paraffin content of 7.5 wt. %. The two runs were continued for about a week at 400 psig, 920°F., 8.7 V/V/Hr. and 2000 SCF $H_2$/B. The following yield and octane data were obtained.

TABLE IV

| Catalyst | | Commercial Hydroforming Catalyst | Palladium-Zinc-Erionite |
|---|---|---|---|
| Hours on feed | | ← 126 — 168 → | |
| | Feed | | |
| $C_5$+, wt. % | 100 | 98.5 | 94.3 |
| n-Paraffins in Liquid Product, Wt. % | 7.5 | 6.7 | 1.9 |
| Octane Number | | | |
| RON (Clear) | 95.7 | 97.4 | 99.8 |
| RON + 3 cc TEL | 101.1 | 102.1 | 103.6 |
| MON (Clear) | 84.8 | 86.5 | 88.2 |
| MON + 3 cc TEL | 90.5 | 94.3 | 95.2 |

The erionite catalyst was demonstrated to be substantially more effective in upgrading the hydroformate feed as indicated by the higher octane number product and the greater degree of n-paraffin removal. As indicated, the loss in $C_5$+ product during the selective conversion with the erionite catalyst was about equal to the weight of normal paraffin removed, whereas no such selective removal was observed with the conventional commercially available hydroforming catalyst. It is quite apparent, therefore, that the present invention offers distinct advantages in the upgrading of previously hydroformed feedstock, which advantages are not attainable by mere repetitive contact with conventional hydroforming catalysts.

EXAMPLE 5

The usefulness of the relatively small pore size catalyst of the invention was demonstrated at less severe operating conditions than utilized in conventional hydroforming operations. The following table summarizes data obtained with the use of the erionite catalyst of Example 2 and the hydroformate feed of Example 4, at a pressure of 400 psig, a hydrogen rate of 2000 SCF per barel, a feed rate of 8.7 V/V/Hr. and at a temperature of 870°F. (as opposed to 920°F. in Example 4). These data are compared to those obtained in Example 4 with the commercially available conventional hydroforming catalyst at the higher temperature of 920°F., the other operating conditions being the same. The erionite catalyst was again sulfided in accordance with the procedure described in Example 2.

TABLE V

| Catalyst | | Commercial Hydroforming Catalyst | Palladium-Zinc-Erionite |
|---|---|---|---|
| Hours on Feed | | ——126 - 168—— | |
| Temperature,°F. | | 920 | 870 |
| | Feed | | |
| $C_5$+, Wt. % | 100 | 98.5 | 95 |
| n-Paraffins in Liquid Product, Wt.% | 7.5 | 6.7 | 1.3 |
| Octane Number | | | |
| RON Clear | 96.2 | 97.4 | 100 |
| MON Clear | 84.8 | 86.5 | 88.2 |

As indicated, the palladium-zinc-erionite catalyst of the invention produced a higher octane product with a substantially greater degree of n-paraffin removal than the conventional hydroforming catalyst, even though the operating temperature was some 50°F. lower.

To further illustrate the advantages of utilizing the catalyst of the invention, the feed rate in the above operations was varied in order to produce the equivalent octane level with the conventional hydroforming catalyst and the relatively small pore size zeolite catalyst of the invention. With the conventional hydroforming catalyst a feed rate of less than about 2 V/V/Hr. was required to produce a product octane number equivalent to that obtained with the zeolite catalyst. The results are summarized in the following table:

TABLE VI

| Catalyst | | Commercial Hydroforming Catalyst | Palladium-Zinc-Erionite |
|---|---|---|---|
| Feed Rate, V/V/Hr. | | 1.8 | 7.9 |
| Hours on Feed | | —— 511-576 —— | |
| Temperature, °F. | | ——920—— | |
| | Feed | | |
| $C_5$+, Wt. % | 100 | 90.6 | 92.1 |
| n-Paraffins in Liquid | | | |

TABLE VI-continued

| | | | |
|---|---|---|---|
| Product, Wt. % | 7.5 | 4.8 | 2.4 |
| Octane Number | | | |
| RON Clear | 96.2 | 99.7 | 99.0 |
| RON + 3 cc TEL | 101.5 | 103.6 | 103.2 |
| MON Clear | 85.9 | — | 90 |
| MON + 3 ccTEL | 92.4 | — | 96 |

As indicated, production of an equivalent octane number by conventional hydroforming required a reduction in feed rate to 1.8 V/V/Hr., thus demonstrating the higher throughput rates attainable by the present process without sacrifice in product quality. Again, the benefits obtained by treating a previously hydroformed feed with the relatively small pore size zeolite catalyst of the invention cannot be achieved by the simple expedient of further conventional hydroforming treatment. It was also observed in the above experiments that serious catalyst deactivation occurred with the conventional hydroforming catalyst whereas little or no deactivation of the sulfided relatively small pore size erionite catalyst was experienced.

To further demonstrate the superiority of the present invention as compared to conventional hydroforming techniques, the catalysts utilized in this example were contacted with the hydroformate feed for an extended period of time in order to demonstrate their activity maintenance. The same process conditions of pressure and gas rate used above were employed herein at a temperature of 920°F. and at the feed rates shown below.

TABLE VII

| Catalyst | | Commercial Hydroforming Catalyst | Palladium-Zinc-Erionite |
|---|---|---|---|
| Hours on Feed | | ———583–624——— | |
| Feed Rate, V/V/Hr. | | 3.9 | 8.9 |
| | Feed | | |
| Temperature, °F. | | ———920——— | |
| $C_5$+, Wt. % | 100 | 95.4 | 94.2 |
| n-Paraffins in Liquid Product, Wt. % | 7.5 | 6.3 | 2.4 |
| Octane Data | | | |
| RON Clear | 96.2 | 98 | 99.3 |
| RON + 3 cc TEL | 101.5 | 101.9 | 103.8 |
| MON Clear | 85.9 | — | 88.6 |
| MON + 3 cc TEL | 92.4 | — | 94.5 |

As indicated, after an extended on-stream period, the catalyst of the invention exhibited substantially the same activity as shown by the n-paraffin removal and octane improvement data, whereas the performance of the conventional hydroforming catalyst is shown to have been diminishing as indicated by the relatively small octane number improvement.

EXAMPLE 6

The hydroforming process of the invention was further demonstrated by processing a virgin naphtha feed over a platinum on alumina base hydroforming catalyst having the composition set forth in Example 4 at an average reactor temperature of 935°F., 3.2 W/W/Hr., 385 psig and at a hydrogen gas rate of 3000 SCF $H_2$/Bbl. feed. An overall yield of 81.2 volume % hydroformate product having a research octane number (clear) of 96 was obtained. The total naphtha product obtained from the initial hydroforming state with conventional catalyst was further treated by passage over a fixed bed of sulfided palladium-zinc-erionite catalyst (as described in Example 2) at 920°F., 8.0 W/W/Hr., 400 psig and 2000 SCF $H_2$/Bbl feed. After 670 hours of operation at these conditions, the product yield was 94.2 wt. % on feed with an octane improvement equivalent to that indicated after 160 hours of operation. The liquid product issuing from the erionite catalyst bed exhibited an increase of 3.5 research octane number units and 2 motor octane number units with a corresponding normal parrafin conversion of 75 wt. % on paraffin feed. Data on the feed and product inspections, octane number and product analysis are summarized in the following table:

TABLE VIII

Two Stage Hydroforming of Virgin Naphtha
920°F., 8 W/W/Hr., 400 psig, 3000 SCF/Bbl.

| | Virgin Naphtha Feed | First Stage Hydroformate Product (Conventional Platinum-Alumina Catalyst) | Second Stage Hydroformate Product (Pd-Zn-Erionite Catalyst) |
|---|---|---|---|
| MB/D | 36 | 29.2 | 27.7 |
| Inspections | | | |
| Gravity, °API at 60°F. | 54.2 | 46.7 | 41.9 |
| D-86 Distillation, °F. | | | |
| I.B.P. | 208 | 104 | 148 |
| 5 | 224 | 148 | 202 |
| 10 | 229 | 174 | 219 |
| 50 | 256 | 261 | 273 |
| 90 | 307 | 324 | 328 |
| 95 | 318 | 349 | 349 |
| F.B.P. | 340 | 377 | 392 |

TABLE VIII-continued

| Two Stage Hydroforming of Virgin Naphtha 920°F., 8 W/W/Hr., 400 psig, 3000 SCF/Bbl. | Virgin Naphtha Feed | First Stage Hydroformate Product (Conventional Platinum-Alumina Catalyst) | Second Stage Hydroformate Product (Pd-Zn-Erionite Catalyst) |
|---|---|---|---|
| Rec., ml. | 99 | 98 | 98 |
| Residue, ml. | 1 | 1 | 1 |
| Octane Data | | | |
| RON Clear | 57 | 96.2 | 99.8 |
| RON + 3 cc TEL | — | 101.5 | 103.6 |
| MON Clear | 56 | 85.9 | 88.2 |
| MON + 3 cc TEL | — | 92.4 | 95.2 |
| Type Analysis | | | |
| Aromatics, Vol. % | 12 | 67 | 72 |
| Normal Paraffins, Vol. | — | 7.2 | 1.9 |
| Naphthenes, Vol. % | 35 | 2 | 2 |
| Saturates, Vol. % | 53 | 30 | 24 |

The above illustrates the process of the present invention. As indicated, the relatively small pore size zeolite catalyst in the last stage of the process substantially increased the octane number of the first hydroforming stage effluent, and was further responsible for a dramatic decrease in normal paraffin content and corresponding increase in aromatics content.

EXAMPLE 7

This example demonstrates the superiority of the Group II-B metal cation modification of the catalyst of the invention over other ion exchanged modifications of the 5A zeolite of Example 1. An Arabian $C_5$ - $C_6$ naphtha was employed as feed. It had a gravity of 85.3° API, a boiling range of 110°–185°F., a normal pentane content of 24.2% and a normal hexane content 22.9%. Catalyst performance was measured by disappearance of normal paraffins and their conversion to $C_4$- gases. For these experiments the catalyst in each instance was sulfactivated in a previous operation in which the $C_5$-$C_6$ feed contained carbon disulfide in amounts ranging from 0.5 to 1%. The test results shown were obtained without added sulfur in each instance except with the nickel catalyst (no palladium), and in this exception the data are representative of operation with 1% carbon disulfide in the feed. Test conditions included: temperature 850°F., pressure 500 psig, exit hydrogen rate 2000–3000 CF/B, and feed rate 0.5 V/V/Hr. The ion modifications tested and the results obtained with each are indicated in the following table:

TABLE IX

| | Feed | Ion Modification of Zeolite | | | | |
|---|---|---|---|---|---|---|
| | | Zn | Ca | Mg | Mn | Ni |
| Palladium content, wt. % | | ——— | ——— | 0.5 | ——— | 0 |
| $C_4$-Product, wt. % | 1.8 | 47.2 | 4.6 | 5.1 | 5.8 | 5.6 |
| Disappearance of $nC_5 + nC_6$, wt. % | — | 35.9 | 0 | 1.3 | 0.7 | 4.8 |
| $nC_5$ in Total Product, wt. % | 24.2 | 8.4 | 23.9 | 22.8 | 24.2 | 19.8 |
| $nC_6$ in Total Product, wt. % | 22.9 | 2.8 | 24.0 | 23.0 | 22.2 | 22.5 |

It is observed from the above table, that the sulfur activated zinc catalyst produced outstanding reduction of normal $C_5$ and $C_6$ parrafins by converting them to $C_4$- gas (predominantly propane and butane), and that conversion over and above this normal paraffin conversion is not excessive. The striking superiority of zinc form of the catalyst over the other cation modifications is clearly demonstrated.

EXAMPLE 8

As previously indicated, sulfactivation of the catalyst of the invention is to be preferred. The desirability of sulfur activation was demonstrated in an experiment with th Arabian $C_5$ - $C_6$ naphtha feed employed in Example 8 with 0.5% aded carbon disulfide. The zinc zeolite catalyst of Example 1, with and without sulfur activation, was employed. The following data includes a comparision of the calcium, magnesium, and nickel modifications without sulfur promoter or activation. The test conditions included: Temperature 850°F.; Pressure 500 psig; Exit Hydrogen Rate 2000–3000 CF/B; and Feed Rate 0.5 V/V/Hr.

TABLE X

| | Feed | Ion Modification of 5A Zeolite | | | | |
|---|---|---|---|---|---|---|
| | | Zn | Zn | Ca | Mg | Ni |
| Wt. % Palladium | | ——— | ——— | 0.5 | ——— | ——— |
| Sulfur Activation | 850°F. with 0.5% $CS_2$ in feed | | none | none | none | none |
| Wt. % $C_4$- Product | 1.8 | 47.2 | 12.9 | 3.8 | 5.6 | 9.9 |
| Wt. % $nC_5 + nC_6$ Disappearance | — | 35.9 | 12.5 | 4.0 | 6.6 | 8.9 |
| Wt. % $nC_5$ in Total | | | | | | |

TABLE X-continued

| | Feed | Ion Modification of 5A Zeolite | | | | |
|---|---|---|---|---|---|---|
| | | Zn | Zn | Ca | Mg | Ni |
| Product | 24.2 | 8.4 | 20.5 | 21.1 | 20.4 | 17.7 |
| Wt. % $nC_6$ in Total Product | 22.9 | 2.8 | 14.1 | 22.0 | 20.1 | 20.5 |

As indicated, without sulfur activation, the zinc modification is superior to the other cation forms as evidenced by the lower amount of normal $C_5$ and normal $C_6$ hydrocarbons and the conversion of these materials to $C_4$- gases. With sulfur activation, the zinc modification exhibits greatly enhanced activity. In a further test the calcium, magnesium and nickel modifications of Example 5 were exhibited to be relatively unresponsive to sulfur activation so as to further distinguish them from the zinc form. Thus, little or no enhancement of activity was obtained by sulfactivation of the Ca, Mg, or Ni forms of the 5A zeolite.

It is to be understood that the present invention is not to be limited by the above description or examples and that variations within the contemplation of those skilled in the art can be employed without departing from the scope of the appended claims.

What is claimed is:

1. A process for upgrading a naphtha feed which comprises subjecting said naphtha feed to hydroforming, removing naphtha fractions from the resulting hydroformate, and contacting said naphtha fractions with a sulfactivated catalyst comprising a metallic hydrogenation component combined with a crystalline alumino-silicate zeolite having uniform pore openings of about 5 Angstrom units, wherein the metal in said metallic hydrogenation component is in a form selected from the group consisting of the free metal, oxide, sulfide and a mixture thereof, and wherein said zeolite has been base exchanged to reduce its alkali metal content to less than 10 wt. % and contains a Group II-B metal, in the presence of added hydrogen, and at a temperature of about 800° to 950°F. and a pressure of about 275 to 500 psig, and recovering a naphtha product having improved octane rating.

2. The process of claim 1, wherein said feed is initially hydroformed with a platinum-on-alumina hydroforming catalyst.

3. The process of claim 2, wherein said Group II-B metal is zinc.

4. The process of claim 3, wherein said zeolite has the crystal structure of erionite.

5. The process of claim 4, wherein said catalyst contains about 0.5 to 15 wt. % sulfur.

6. The process of claim 5, wherein said metallic hydrogenation component is a platinum group metal.

7. A process for upgrading the naphtha feed which comprises subjecting said feed to hydroforming, contacting the entire hydroformed naphtha feed with a sulfactivated catalyst comprising a metallic hydrogenation component combined with a crystalline alumino-silicate zeolite having uniform pore openings of about 5 Angstrom units, wherein the metal in said metallic hydrogenation component is in a form selected from the group consisting of the free metal, oxide, sulfide and a mixture thereof, and wherein said zeolite has been base exchanged to reduce its alkali metal content to less than 10 wt. % and contains a Group II-B metal, in the presence of added hydrogen, and at a temperature of about 800° to 950°F. and a pressure of about 275 to 500 psig, and recovering a naphtha product having improved octane rating.

8. The process of claim 7, wherein said feed is initially hydroformed with a platinum-on-alumina hydroforming catalyst.

9. The process of claim 8, wherein said Group II-B metal is zinc.

10. The process of claim 9, wherein said zeolite has the crystal structure of erionite.

11. The process of claim 10, wherein said zeolite has been base exchanged with a hydrogen precursor ion.

12. The process of claim 11, wherein said catalyst contains 0.5 to 15 wt. % sulfur.

13. The process of claim 12, wherein said metallic hydrogenation comprises a platinum group metal.

* * * * *